US007535178B2

(12) United States Patent
Ushizawa et al.

(10) Patent No.: US 7,535,178 B2
(45) Date of Patent: May 19, 2009

(54) PLASMA DISPLAY PANEL

(75) Inventors: Masahiko Ushizawa, Yamanashi-ken (JP); Takashi Ohtoh, Yamanashi-ken (JP); Kunimoto Tsuchiya, Yamanashi-ken (JP)

(73) Assignee: Pioneer Corporation, Meguro-ku, Tokyo (JP)

( * ) Notice: Subject to any disclaimer, the term of this patent is extended or adjusted under 35 U.S.C. 154(b) by 0 days.

(21) Appl. No.: 11/221,892

(22) Filed: Sep. 9, 2005

(65) Prior Publication Data

US 2006/0066240 A1 Mar. 30, 2006

(30) Foreign Application Priority Data

Sep. 10, 2004 (JP) ..... 2004-263772

(51) Int. Cl.
*H01J 17/49* (2006.01)

(52) U.S. Cl. ..... 313/586; 313/582; 313/585

(58) Field of Classification Search ..... 313/582–587
See application file for complete search history.

(56) References Cited

U.S. PATENT DOCUMENTS

| | | | | |
|---|---|---|---|---|
| 6,747,410 | B1 * | 6/2004 | Yokoyama et al. | 313/584 |
| 2004/0056594 | A1 * | 3/2004 | Kotera et al. | 313/582 |
| 2004/0075388 | A1 * | 4/2004 | Miyashita et al. | 313/586 |
| 2005/0082982 | A1 * | 4/2005 | Kim | 313/587 |
| 2005/0206318 | A1 * | 9/2005 | Hirota et al. | 313/585 |
| 2006/0055325 | A1 * | 3/2006 | Hirota et al. | 313/587 |

FOREIGN PATENT DOCUMENTS

| | | |
|---|---|---|
| JP | 06-325696 | 11/1994 |
| JP | 07-037510 | 2/1995 |

(Continued)

OTHER PUBLICATIONS

"What is salt?" from the Salt Institute: http://www.saltinstitute.org/15.html.*

Kalder et al., "Short-Wave Luminance of MgO Crystals", Shurnal Prikladnoi Spektroskopii, vol. 25, No. 4, pp. 1250-1255, Oct. 1976.*

A. Nishida, A. Ueki, and H. Mashida "Preparation and Properties of Magnesia Powder by Vapor Phase Oxidation Process", Journal of the Society of Materials Science, Japan, vol. 36, No. 410, pp. 1157-1161, Nov. 1987.

*Primary Examiner*—Nimeshkumar D. Patel
*Assistant Examiner*—Anne M Hines
(74) *Attorney, Agent, or Firm*—McGinn IP Law Group, PLLC

(57) ABSTRACT

A plasma display panel has the front glass substrate and the back glass substrate which are placed opposite each other on either side of a discharge space, row electrode pairs formed on the front glass substrate, a dielectric layer covering the row electrode pairs, and a protective layer covering the dielectric layer. The protective layer has a structure of a lamination of a thin-film MgO layer by either vapor deposition or spattering and a MgO layer including magnesium oxide crystals causing a cathode-luminescence emission having a peak within a wavelength range of 200 nm to 300 nm upon excitation by an electron beam. A ternary discharge gas including neon, xenon and helium fills the discharge space.

12 Claims, 9 Drawing Sheets

FOREIGN PATENT DOCUMENTS

| | | |
|---|---|---|
| JP | 07-192630 | 7/1995 |
| JP | 07-296718 | 11/1995 |
| JP | 08-287823 | 11/1995 |
| JP | 09-167566 | 6/1997 |
| JP | 10-233157 | 9/1998 |
| JP | 2001-076629 | 3/2001 |
| JP | 2002-033053 | 1/2002 |
| JP | 2003-031130 | 1/2003 |

* cited by examiner

EMBODIMENT

SECTION V-V

SECTION W-W

SINGLE CRYSTAL OF
CUBIC SINGLE - CRYSTAL STRUCTURE

SINGLE CRYSTALLINE MgO OF
CUBIC POLYCRYSTAL STRUCTURE

DISCHARGE PROBABILITY vs He/Ne RATIO

FORMATIVE DISCHARGE DELAY TIME vs He/Ne RATIO

PLASMA DISPLAY PANEL

BACKGROUND OF THE INVENTION

1. Field of the Invention

This invention relates to a structure of plasma display panels.

The present application claims priority from Japanese Application No. 2004-263772, the disclosure of which is incorporated herein by reference.

2. Description of the Related Art

A surface-discharge-type alternating-current plasma display panel (hereinafter referred to as "PDP") has two opposing glass substrates placed on either side of a discharge-gas-filled discharge space. One of the two glass substrates has row electrode pairs extending in the row direction and regularly arranged in the column direction. The other glass substrate has column electrodes extending in the column direction and regularly arranged in the row direction. Unit light emission areas (discharge cells) are formed in matrix form in positions corresponding to the intersections between the row electrode pairs and the column electrodes in the discharge space.

The PDP further has a dielectric layer provided for covering the row electrodes or the column electrodes. A magnesium oxide (MgO) film is formed on a portion of the dielectric layer facing each of the unit light emission areas. The MgO film has the function of protecting the dielectric layer and the function of emitting secondary electrons into the unit light emission area.

The MgO film of such conventional PDPs is formed by the use of a screen printing technique to apply a coating of a paste containing an MgO powder mixture onto the dielectric layer. Such a conventional MgO film is suggested in Japanese Patent Laid-open Application No. 6-325696, for example.

However, the conventional MgO film is formed by use of a screen printing technique to apply a coating of a paste mixed with a polycrystalline floccule type magnesium oxide obtained by heat-treating and purifying magnesium hydroxide. Therefore, this MgO film thus formed provides the discharge characteristics of the PDP merely to an extent equal to or slightly greater than that provided by a magnesium oxide film formed by the use of evaporation technique.

An urgent need arising from this is to form a protective film capable of yielding a greater improvement in the discharge characteristics of the PDP.

SUMMARY OF THE INVENTION

An object of the present invention is to solve the problem associated with conventional PDPs having a magnesium oxide film formed as described above.

To attain this object, the present invention provides a plasma display panel that has a pair of substrates placed opposite each other on either side of a discharge space, discharge electrodes formed on one of the opposing substrates and a dielectric layer covering the discharge electrodes, and is characterized by a protective layer that covers the dielectric layer and has a magnesium oxide layer including magnesium oxide crystals causing a cathode-luminescence emission having a peak within a wavelength range of 200 nm to 300 nm upon excitation by an electron beam, and by a ternary discharge gas including neon, xenon and helium and filling the discharge space.

As an exemplary embodiment of the best mode for carrying out the present invention, a PDP has a front glass substrate and a back glass substrate between which are provided row electrode pairs extending in a row direction and column electrodes extending in a column direction to form discharge cells in the discharge space in positions corresponding to intersections with the row electrode pairs. The PDP further has a protective layer formed on a portion of the dielectric layer facing at least each discharge cell, the dielectric layer covering either the row electrode pairs or the column electrodes. The protective layer has a double-layer structure of a lamination of a thin-film magnesium oxide layer by either vapor deposition or spattering and a magnesium oxide layer including magnesium oxide crystals causing a cathode-luminescence emission having a peak within a wavelength range of 200 nm to 300 nm upon excitation by an electron beam. The discharge space is filled with a ternary discharge gas including neon, xenon and helium.

In the PDP in the embodiment, the MgO layer, which is one of the layers constituting the protective layer of the laminated structure covering the dielectric layer, includes the MgO crystals causing a cathode-luminescence emission having a peak within a wavelength range of 200 nm to 300 nm upon excitation by an electron beam. As a result, the discharge characteristics in the PDP, such as the probability of discharge and those relating to the discharge delay, are improved, and thus the PDP is capable of showing satisfactory discharge characteristics.

Further, the ternary gas mixture of neon, xenon and helium is used as the discharge gas filling the discharge space. This makes it possible to reduce the formative delay time, in addition to the effect of reducing the statistical discharge delay time produced by the MgO layer causing the cathode-luminescence emission.

These and other objects and features of the present invention will become more apparent from the following detailed description with reference to the accompanying drawings.

DETAILED DESCRIPTION OF THE PREFERRED EMBODIMENTS

Figure 1:
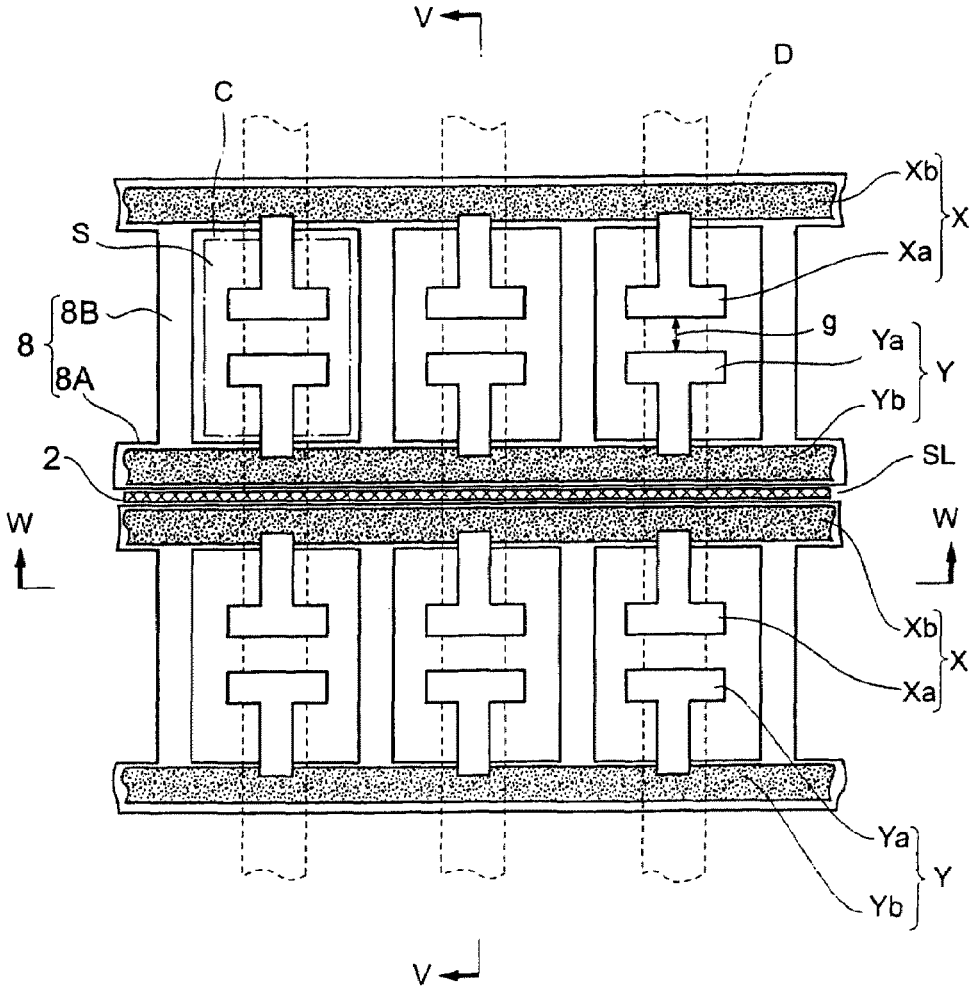
FIG. 1 is a front view illustrating an embodiment of the present invention.
Figure 2:
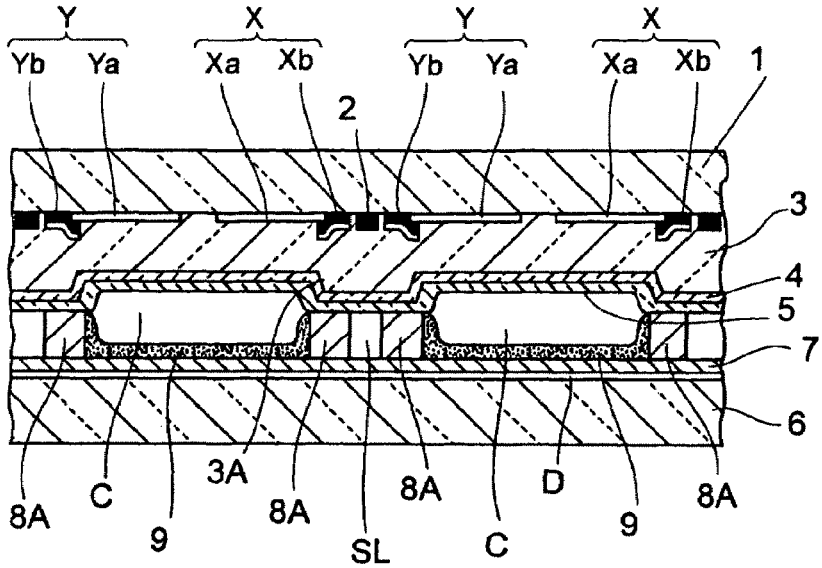
FIG. 2 is a sectional view taken along the V-V line in FIG. 1.
Figure 3:
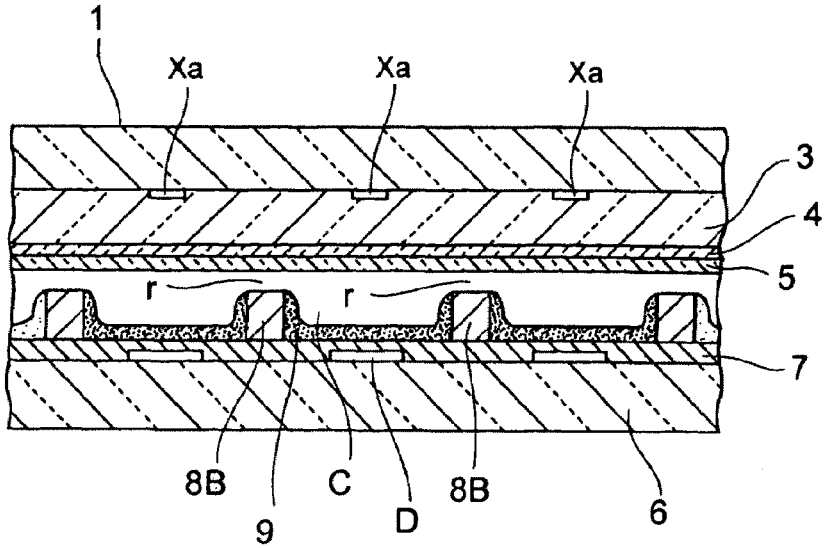
FIG. 3 is a sectional view taken along the W-W line in FIG. 1.

FIGS. 1 to 3 illustrate an embodiment of a PDP according to the present invention. FIG. 1 is a schematic front view of the PDP in the embodiment. FIG. 2 is a sectional view taken along the V-V line in FIG. 1. FIG. 3 is a sectional view taken along the W-W line in FIG. 1.

The PDP in FIGS. 1 to 3 has a plurality of row electrode pairs (X, Y) extending and arranged in parallel on the rear-facing face (the face facing toward the rear of the PDP) of a front glass substrate 1 serving as a display surface in a row direction of the front glass substrate 1 (the right-left direction in FIG. 1).

A row electrode X in each row electrode pair (X, Y) is composed of T-shaped transparent electrodes Xa formed of a transparent conductive film made of ITO or the like, and a bus electrode Xb formed of a metal film. The bus electrode Xb extends in the row direction of the front glass substrate 1. The narrow proximal end (corresponding to the foot of the "T") of each transparent electrode Xa is connected to the bus electrode Xb.

Likewise, a row electrode Y is composed of T-shaped transparent electrodes Ya formed of a transparent conductive film made of ITO or the like, and a bus electrode Yb formed of a metal film. The bus electrode Yb extends in the row direction of the front glass substrate 1. The narrow proximal end of each transparent electrode Ya is connected to the bus electrode Yb.

The row electrodes X and Y are arranged in alternate positions in a column direction of the front glass substrate 1 (the vertical direction in FIG. 1). In each row electrode pair (X, Y), the transparent electrodes Xa and Ya are regularly spaced along the associated bus electrodes Xb and Yb and each extends out toward its counterpart in the row electrode pair, so that the wide distal ends (corresponding to the head of the "T") of the transparent electrodes Xa and Ya face each other with a discharge gap g having a required width in between.

Black- or dark-colored light absorption layers (light-shield layers) 2 are further formed on the rear-facing face of the front glass substrate 1. Each of the light absorption layers 2 extends in the row direction along and between the back-to-back bus electrodes Xb and Yb of the row electrode pairs (X, Y) adjacent to each other in the column direction.

A dielectric layer 3 is formed on the rear-facing face of the front glass substrate 1 so as to cover the row electrode pairs (X, Y), and has additional dielectric layers 3A projecting from the rear-facing face thereof. Each of the additional dielectric layers 3A extends in parallel to the back-to-back bus electrodes Xb, Yb of the adjacent row electrode pairs (X, Y) in a position opposite to the bus electrodes Xb, Yb and the area between the bus electrodes Xb, Yb.

On the rear-facing faces of the dielectric layer 3 and the additional dielectric layers 3A, a magnesium oxide layer 4 of thin film (hereinafter referred to as "thin-film MgO layer 4") formed by vapor deposition or spattering and covers the entire rear-facing faces of the layers 3 and 3A.

A magnesium oxide layer 5 including magnesium oxide single crystals (hereinafter referred to as "crystalline MgO layers 5") is formed on the rear-facing face of the thin-film MgO layer 4. The magnesium oxide single crystals included in the crystalline MgO layer 5 cause a cathode-luminescence emission (CL emission) having a peak within a wavelength range of 200 nm to 300 nm (particularly, of 230 nm to 250 nm, around 235 nm) upon excitation by electron beams as described later.

The crystalline MgO layer 5 is formed on the entire rear-facing face of the thin-film MgO layer 4, or alternatively on a part of the rear-facing face of the thin-film MgO layer 4 facing each discharge cell which will be described later, for example (FIGS. 1 to 3 illustrate the case where the crystalline MgO layer 5 is formed on the entire rear-facing face of the thin-film MgO layer 4).

The front glass substrate 1 is parallel to a back glass substrate 6. Column electrodes D are arranged in parallel at predetermined intervals on the front-facing face (the face facing toward the display surface) of the back glass substrate 6. Each of the column electrodes D extends in a direction at right angles to the row electrode pair (X, Y) (i.e. the column direction) along a strip opposite to the paired transparent electrodes Xa and Ya of each row electrode pair (X, Y).

On the front-facing face of the back glass substrate 6, a white column-electrode protective layer (dielectric layer) 7 covers the column electrodes D and in turn partition wall units 8 are formed on the column-electrode protective layer 7.

Each of the partition wall units 8 is formed in an approximate ladder shape made up of a pair of transverse walls 8A extending in the row direction in the respective positions opposite to the bus electrodes Xb and Yb of each row electrode pair (X, Y), and vertical walls 8B each extending in the column direction between the pair of transverse walls 8 in a mid-position between the adjacent column electrodes D. The partition wall units 8 are regularly arranged in the column direction in such a manner as to form an interstice SL extending in the row direction between the back-to-back transverse walls 8A of the adjacent partition wall units 8.

The ladder-shaped partition wall units 8 partition the discharge space S defined between the front glass substrate 1 and the back glass substrate 6 into quadrangles to form discharge cells C in positions each corresponding to the paired transparent electrodes Xa and Ya of each row electrode pair (X, Y).

In each discharge cell C, a phosphor layer 9 covers five faces: the side faces of the transverse walls 8A and the vertical walls 8B of the partition wall unit 8 and the face of the column-electrode protective layer 7. The three primary colors, red, green and blue, are individually applied to the phosphor layers 9 such that the red, green and blue discharge cells C are arranged in order in the row direction.

The crystalline MgO layer 5 covering the additional dielectric layers 3A (or the thin-film MgO layer 4 in the case where the crystalline MgO layer 5 is formed on a portion of the rear-facing face of the thin-film MgO layer 4 facing each discharge cell C) is in contact with the front-facing face of each of the transverse walls 8A of the partition wall units 8 (see FIG. 2), so that each of the additional dielectric layers 3A blocks off the discharge cells C and the interstice SL from each other. However, the front-facing face of the vertical wall 8B is out of contact with the crystalline MgO layer 5 (see FIG. 3), to form a clearance r therebetween, so that the adjacent discharge cells C in the row direction interconnect with each other by means of the clearance r.

The discharge space S is filled with a discharge gas which is a ternary gas mixture of neon, xenon and helium described later.

MgO crystals, used as materials for forming the crystalline MgO layer 5 and causing CL emission having a peak within a wavelength range of 200 nm to 300 nm (particularly, of 230 nm to 250 nm, around 235 nm) by being excited by an electron beam, include crystals such as a single crystal of magnesium which is obtained, for example, by performing vapor-phase oxidization on magnesium steam generated by heating magnesium (this single crystal of magnesium is hereinafter referred to as "vapor-phase MgO single crystal").

Figure 4:
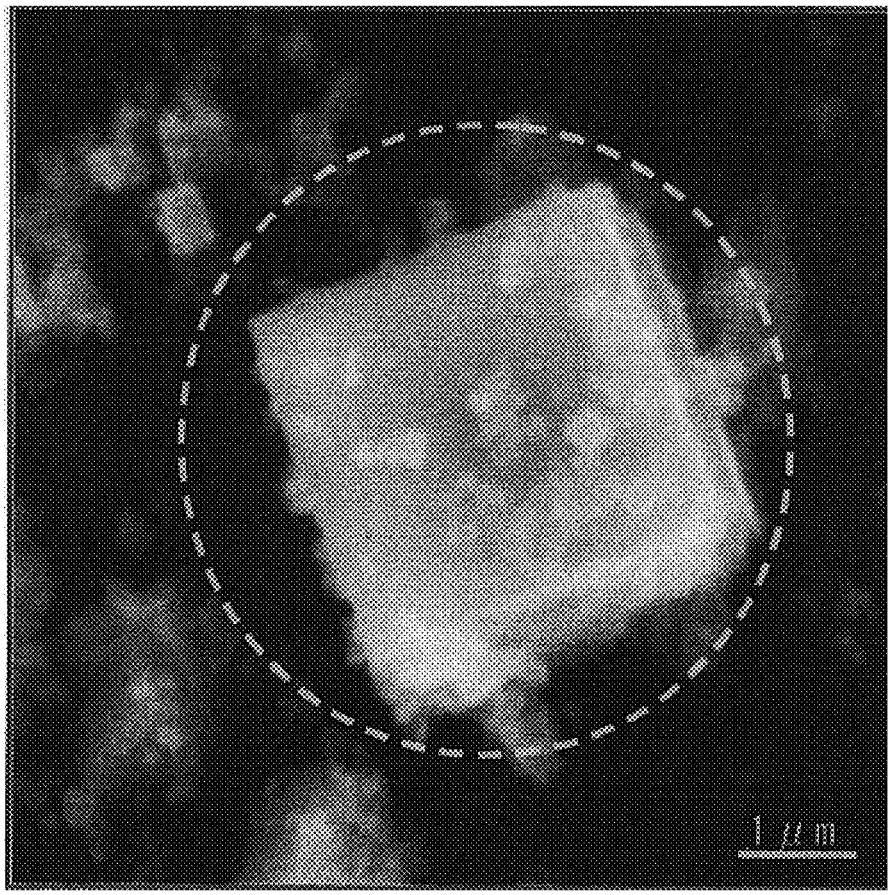
FIG. 4 is a SEM photograph of the magnesium oxide single crystal having a cubic single-crystal structure.
Figure 5:
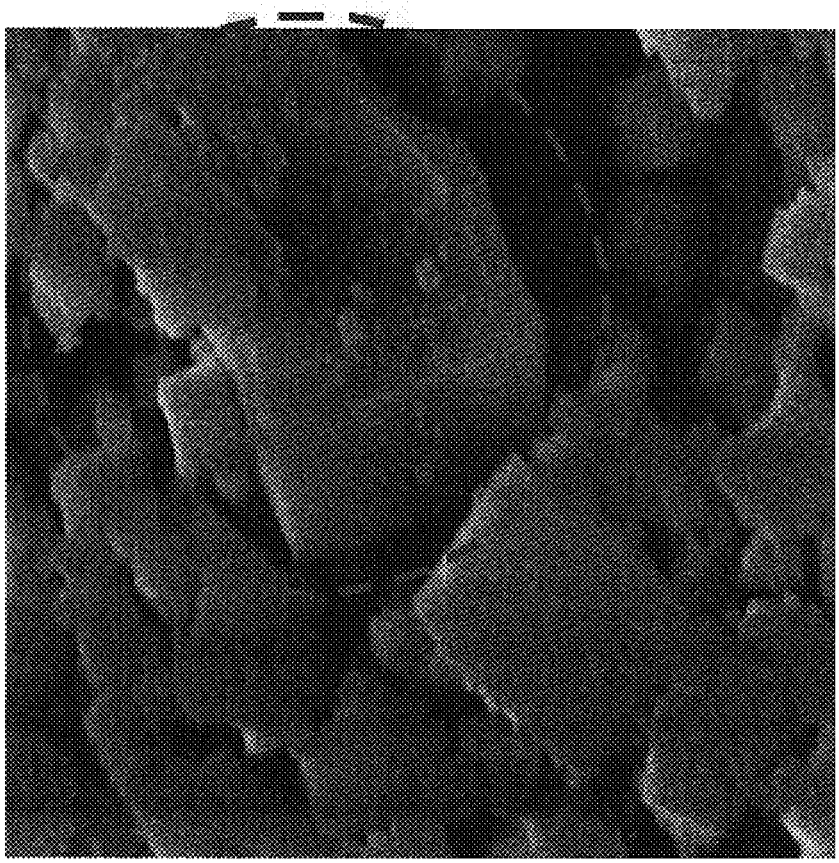
FIG. 5 is a SEM photograph of the magnesium oxide single crystal having a cubic polycrystal structure.

As the vapor-phase MgO single crystals are included an MgO single crystal having a cubic single crystal structure as illustrated in the SEM photograph in FIG. 4, and an MgO single crystal having a structure of cubic crystals fitted to each other (i.e. a cubic polycrystal structure) as illustrated in the SEM photograph in FIG. 5, for example.

Such vapor-phase MgO single crystals are affixed to the rear-facing surface of the thin-film MgO layer 4 covering the dielectric layer 3 and the additional dielectric layers 3A to form the crystalline MgO layer 5 by use of a spraying technique, electrostatic coating technique or the like.

The vapor-phase MgO single crystals contribute to an improvement of the discharge characteristics such as a reduction in discharge delay as described later.

As compared with that obtained by other methods, the vapor-phase magnesium oxide single crystal has the features of being of a high purity, taking a microscopic particle form, causing less particle agglomeration, and the like.

The vapor-phase MgO single crystal used in the embodiment has an average particle diameter of 500 or more angstroms (preferably, 2000 or more angstroms) based on a measurement using the BET method.

Note that the preparation of the vapor-phase MgO single crystal is described in "Preparation of magnesia powder using a vapor phase method and its properties" ("Zairyou (Materials)" vol. 36, no. 410, pp. 1157-1161, the November 1987 issue), and the like.

The embodiment is described about the case where the thin-film MgO layer 4 is formed on the rear-facing faces of the dielectric layer 3 and the additional dielectric layers 3A, and then the crystalline MgO layer 5 is formed on the thin-film MgO layer 4. However, the crystalline MgO layer 5 may be formed on the rear-facing faces of the dielectric layer 3 and the additional dielectric layers 3A and then the thin-film MgO layer 4 may be formed on the rear-facing face of the crystalline MgO layer 5.

Figure 6:
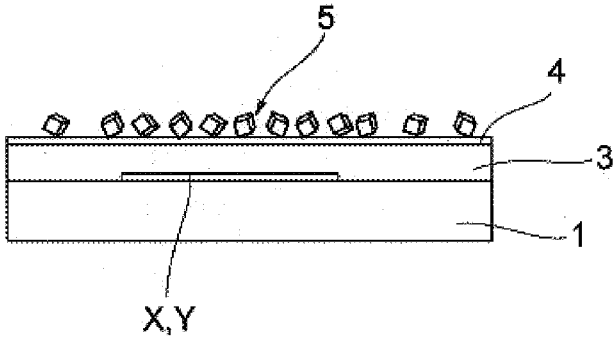
FIG. 6 is a sectional view showing the state of a crystalline magnesium layer formed on a thin film magnesium layer in the embodiment.

FIG. 6 shows the state when the thin-film MgO layer 4 is first formed on the rear-facing face of the dielectric layer 3 and then the powder of vapor-phase MgO single crystals is affixed to the rear-facing face of the thin-film MgO layer 4 to form the crystalline MgO layer 5 by use of a spraying technique, electrostatic coating technique or the like.

Figure 7:
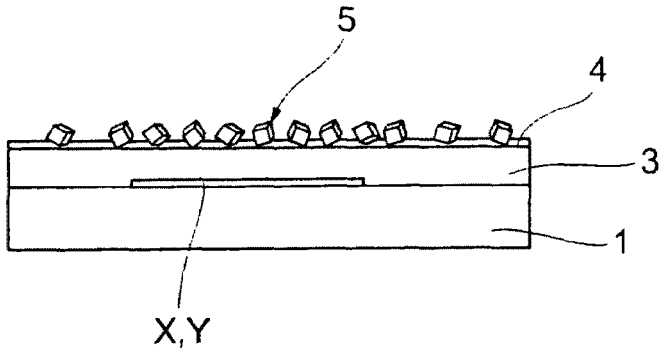
FIG. 7 is a sectional view showing the state of a thin film magnesium layer formed on a crystalline magnesium layer in the embodiment.

FIG. 7 shows the state when the powder of vapor-phase MgO single crystals is affixed to the rear-facing face of the dielectric layer 3 to form the crystalline MgO layer 5 by use of a spraying technique, electrostatic coating technique or the like, and then the thin-film MgO layer 4 is formed.

In the above-mentioned PDP, a reset discharge, an address discharge and a sustaining discharge for generating an image are produced in the discharge cells C.

The priming effect resulting from the reset discharge initiated prior to the initiation of the address discharge lasts long because of the crystalline MgO layer 5 formed in the discharge cells C, resulting in a speeding up of the address discharge process.

Figure 8:
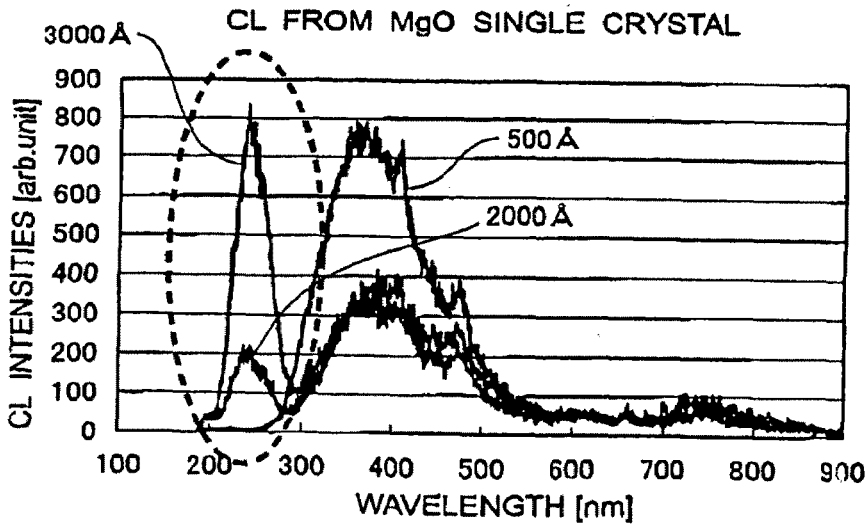
FIG. 8 is a graph showing the relationship between the particle sizes of magnesium oxide single crystals and the wavelengths of CL emission in the embodiment.
Figure 9:
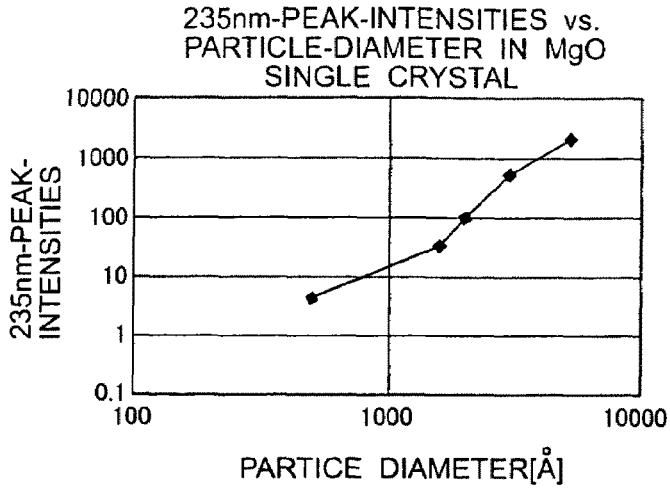
FIG. 9 is a graph showing the relationship between the particle sizes of magnesium oxide single crystals and the intensities of CL emission at 235 nm in the embodiment.

The crystalline MgO layer 5 is formed of the vapor-phase MgO single crystal as described earlier, and the vaporphase MgO single crystal has a crystalline structure that causes a CL emission having a peak within a wavelength range of 200 nm to 300 nm (particularly, of 230 nm to 250 nm, around 235 nm), in addition to a CL emission having a peak within a wavelength range of 300 nm to 400 nm, from the large-particle-diameter vapor-phase MgO single crystal included in the crystalline MgO layer 5, as shown in FIGS. 8 and 9.

Figure 10:
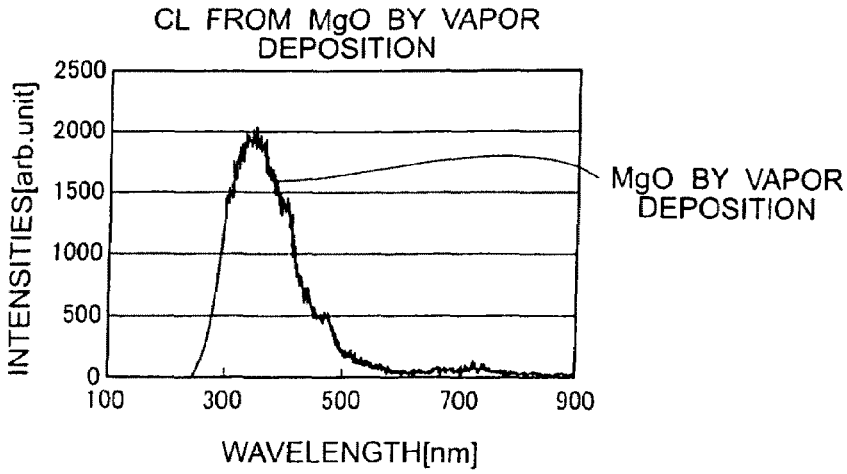
FIG. 10 is a graph showing the state of the wavelength of CL emission from the magnesium oxide layer formed by vapor deposition.

As shown in FIG. 10, a CL emission with a 235 nm peak wavelength is not excited from a MgO layer formed typically by use of vapor deposition (the thin-film MgO layer 4 in the embodiment), but only a CL emission having a peak wavelengths from 300 nm to 400 nm is excited.

As seen from FIGS. 8 and 9, the greater the particle diameter of the vapor-phase MgO single crystal, the stronger the peak intensity of the CL emission having a peak within the wavelength range from 200 nm to 300 nm (particularly, of 230 nm to 250 nm, around 235 nm).

It is conjectured that the crystalline structure of the vapor-phase MgO single crystal causing the CL emission having the peak wavelength from 200 nm to 300 nm will bring about a further improvement of the discharge characteristics (a reduction in discharge delay, an increase in the probability of a discharge).

Also, because of the correlation between the intensity of the CL emission and the particle size of the vapor-phase MgO single crystal, the stronger the intensity of the CL emission having a peak within the wavelength range from 200 nm to 300 nm (particularly, of 230 nm to 250 nm, around 235 nm), the greater the improvement of the discharge characteristics caused by the vapor-phase MgO single crystal.

In other words, when a vapor-phase MgO single crystal to Be depostied has a large particle size, an increase in the heating temperature for generating magnesium vapor is required. Because of this, the length of flame with which magnesium and oxygen react increases, and therefore the temperature difference between the flame and the surrounding ambience increases. Thus, it is conceivable that the larger the particle size of the vapor-phase MgO single crystal, the greater the number of energy levels occurring in correspondence with the peak wavelengths (e.g. around 235 nm, a range from 230 nm to 250 nm) of the CL emission as described earlier.

In a further conjecture regarding the vapor-phase MgO single crystal of a cubic polycrystal structure, many plane defects occur, and the presence of energy levels arising from these plane defects contributes to an improvement in discharge probability.

The BET specific surface area (s) is measured by a nitrogen adsorption method. The particle diameter ($D_{BET}$) of the vapor-phase MgO single crystal powder forming the crystalline MgO layer 5 is calculated from the measured value by the following equation.

$$D_{BET}=A/(s\times\rho),$$

where

A: shape count (A=6)

ρ: real density of magnesium.

Figure 11:
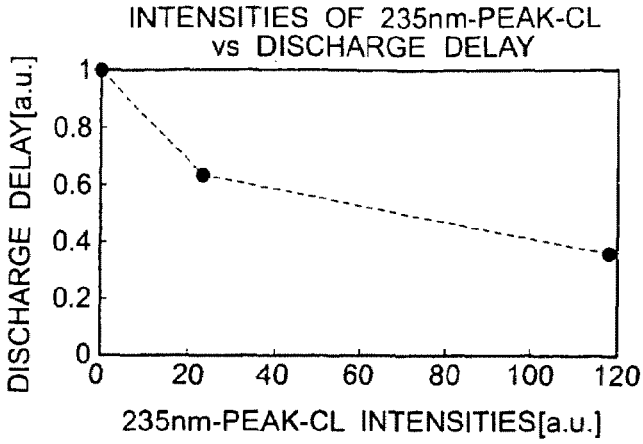
FIG. 11 is a graph showing the relationship between the discharge delay and the peak intensities of CL emission at 235 nm from the magnesium oxide single crystal.

FIG. 11 is a graph showing the correlatioship between the CL emission intensities and the discharge delay.

It is seen from FIG. 11 that the display delay in the PDP is shortened by the 235-nm CL emission excited from the crystalline MgO layer 5, and further as the intensity of the 235-nm CL emission increases, the discharge delay time is shortened.

Figure 12:
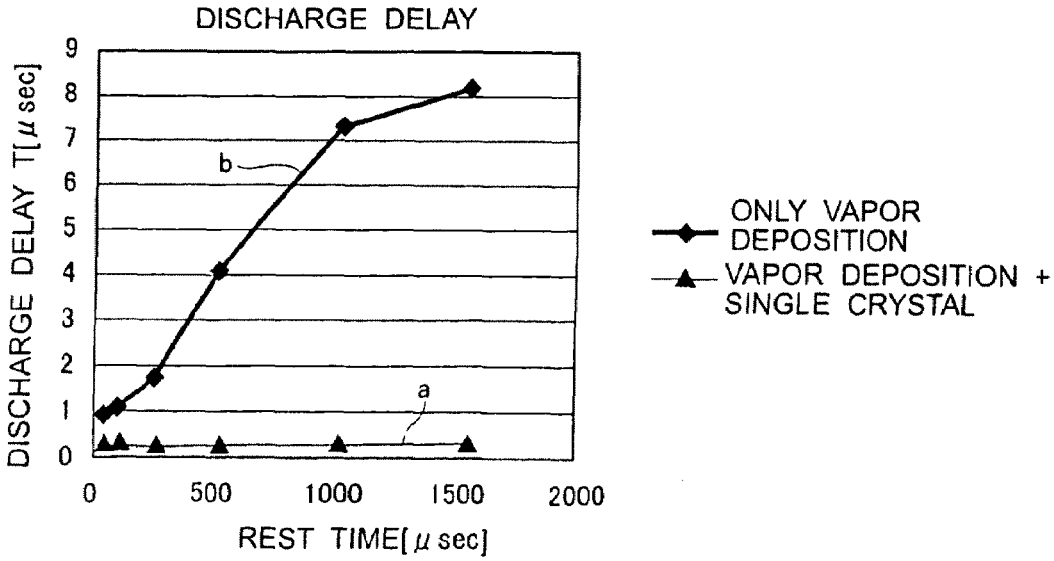
FIG. 12 is a graph showing the comparison of the discharge delay characteristics between the case when the protective layer consists of only the magnesium oxide layer formed by vapor deposition and that when the protective layer has a double layer structure made up of a crystalline magnesium layer and a thin film magnesium layer formed by vapor deposition.

FIG. 12 shows the comparison of the discharge delay characteristics between the case of the PDP having the double-layer structure of the thin-film MgO layer 4 and the crystalline MgO layer 5 as described earlier (Graph a), and the case of a conventional PDP having only a MgO layer formed by vapor deposition (Graph b).

As seen from FIG. 12, the double-layer structure of the thin-film MgO layer 4 and the crystalline MgO layer 5 of the PDP according to the present invention offers a significant improvement in the discharge delay characteristics of the PDP over that of a conventional PDP having only a thin-film MgO layer formed by vapor deposition.

Figure 13:
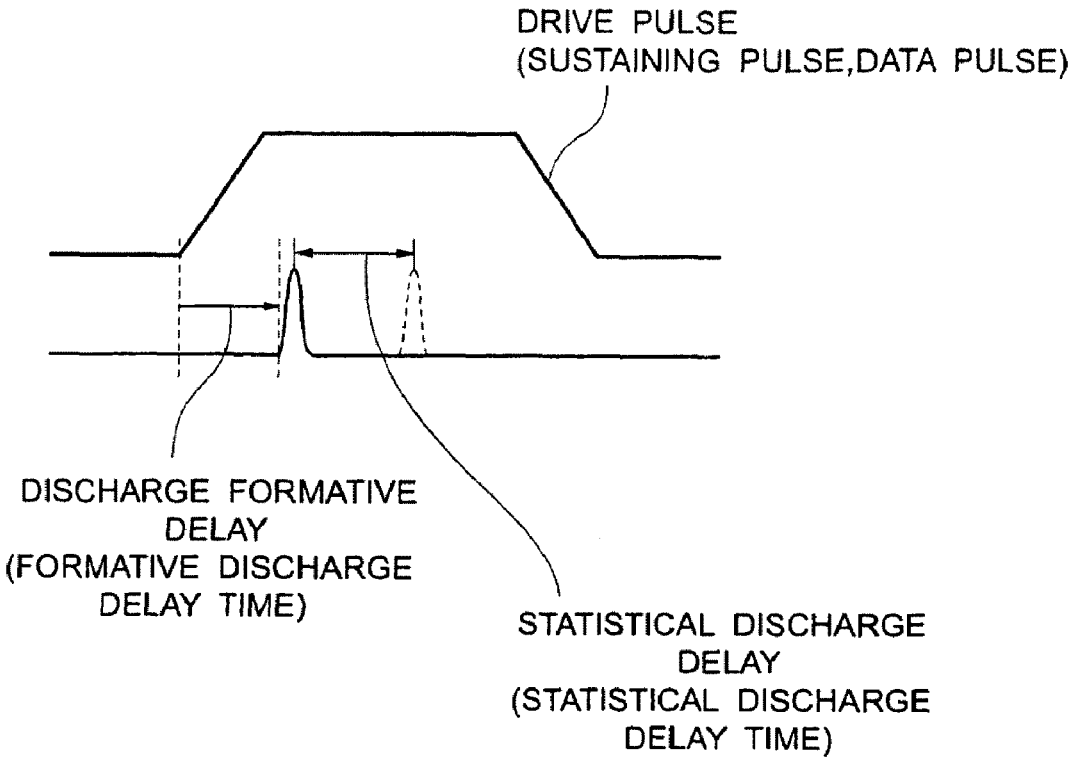
FIG. 13 is a diagram illustrating discharge delay time.

Next, regarding the statistical discharge delay time (discharge variation) and the formative discharge delay time (delay time from the start of the drive pulse application to the start of the discharge) in the PDP as shown in FIG. 13, only when the crystalline MgO layer 5 is provided in such a manner as to face each discharge cell C, the statistical discharge delay time is shortened, but the formative discharge delay time is not much different than that when only the thin-film MgO layer 4 is formed.

Thus, a discharge gas filling in the discharge space in conventional PDPs is a binary gas mixture of xenon and neon, but the PDP in the embodiment uses a ternary gas mixture of neon, xenon and helium as a discharge gas filling in the discharge space.

The mixing of helium into the discharge gas results in a reduction in the formative discharge delay time and improvement of the luminous efficiency, with the effect of the crystalline MgO layer 5 on a reduction in the statistical discharge delay time being maintained.

The concentration ratio of helium to neon (He/Ne) in the discharge gas is set within the range of 0.5 to 1.5, preferably of 0.5 to 1.0.

When the ratio of xenon in the discharge gas is $\alpha$, an optimum composition ratio of the discharge gas is defined as follows:

Xe is $\alpha$

Ne ranges from $(1-\alpha)\times 2/3$ to $(1-\alpha)\times 1/2$

He ranges from $(1-\alpha)\times 1/3$ to $(1-\alpha)\times 1/2$.

Figure 14:
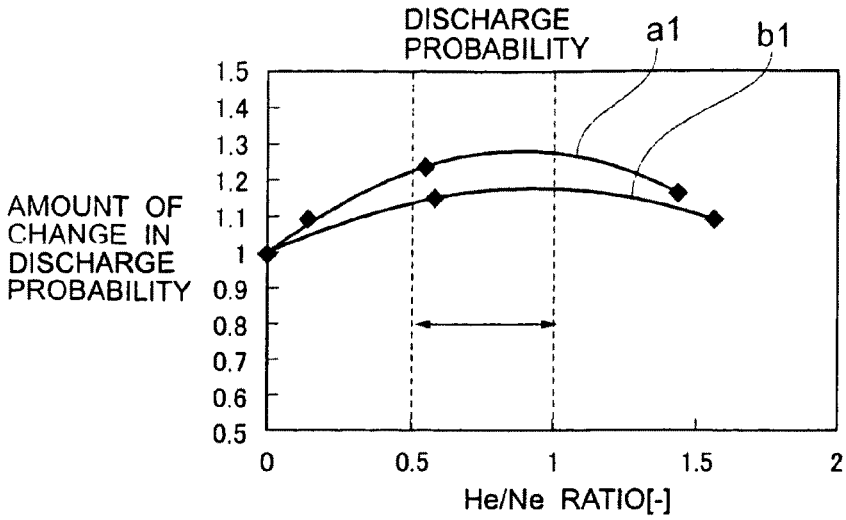
FIG. 14 is a graph showing the relationship between the discharge probability and the He/Ne ratio in the discharge gas.

The graph in FIG. 14 shows the relationship between the concentration ratio of helium to neon (He/Ne) and the discharge probability.

In this connection, there is an inverse relationship between the statistical discharge delay and the discharge probability. That is, when the discharge probability is high, the statistical discharge delay is short (discharge variation is tiny), and when the discharge probability is low, the statistical discharge delay is long (discharge variation is great).

In FIG. 14, line a1 shows the case when a xenon concentration A is a reference value, and line b1 shows the case when a xenon concentration is 1.15 times higher than the xenon concentration A.

Figure 15:
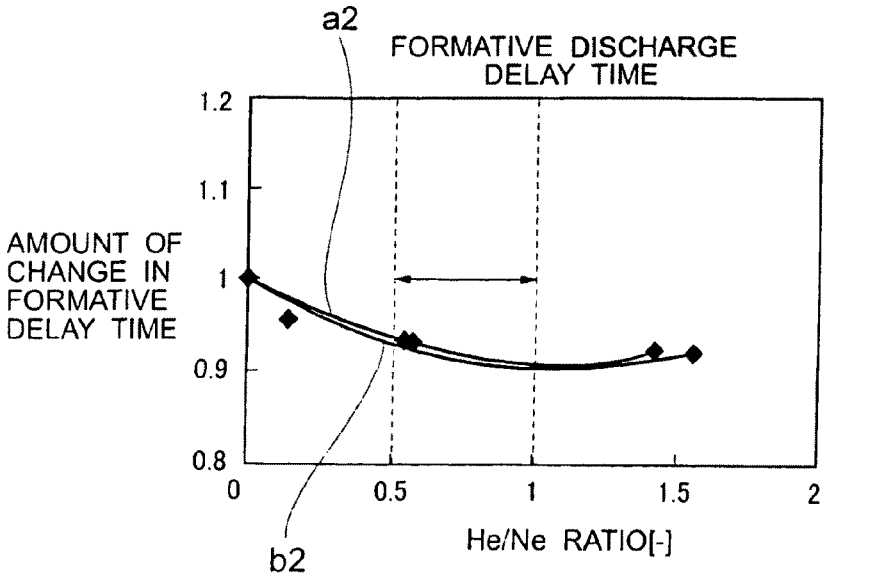
FIG. 15 is a graph showing the relationship between the formative discharge delay time and the He/Ne ratio in the discharge gas.

The graph in FIG. 15 shows the relationship between the concentration ratio of helium to neon (He/Ne) and the formative discharge delay time.

In FIG. 15, line a2 shows the case when a xenon concentration A is a reference value, and line b2 shows the case when a xenon concentration is 1.15 times higher than the xenon concentration A.

As seen from FIGS. 14 and 15, the mixing of the predetermined amount of helium into the discharge gas provides a further improvement in the discharge probability (the statistical discharge delay time) and a reduction in the formative discharge delay time. Further, when a concentration ratio of helium to neon (He/Ne) ranges from 0.5 to 1.0, the discharge probability reaches maximum (the statistical discharge delay time becomes shortest) and the formative discharge delay time becomes shortest.

The improvements of the discharge probability (the statistical discharge delay time) and the formative discharge delay time result in achievement of speedup of the address discharge.

As described hitherto, the PDP of the present invention has, in addition to the conventional type of the thin-film MgO layer 4 formed by vapor deposition or the like, the crystalline MgO layer 5 formed of the vapor-phase MgO single crystals causing a cathode-luminescence emission having a peak within a wavelength range from 200 nm to 300 nm upon excitation by an electron beam. This design allows an improvement of the discharge characteristics such as those relating to the discharge delay. Thus, the PDP of the present invention is capable of showing satisfactory discharge characteristics.

The ternary gas mixture of neon, xenon and helium replaces the conventional binary gas mixture of xenon and neon for the use as the discharge gas filling the discharge space S. As a result, in addition to the effect of reducing the statistical discharge delay time produced by the crystalline MgO layer 5, a reduction in the formative discharge delay time is possible.

The crystalline MgO layer 5 is not necessarily required to cover the entire face of the thin-film MgO layer 4 as described earlier. The crystalline MgO layer 5 may be partially formed by patterning in each of positions facing the transparent electrodes Xa, Ya of the row electrodes X, Y or a position facing any area other than the transparent electrodes Xa, Ya, for example.

When the crystalline MgO layer 5 is partially formed, the area ratio of the crystalline MgO layer 5 to the thin-film MgO layer 4 is set at from 0.1% to 85%, for example.

In the embodiment, without forming the thin-film MgO layer, the protective layer may have a single-layer structure constituted of the crystalline MgO layer 5.

The foregoing has described the example when the present invention applies to a reflection type AC PDP having the front glass substrate on which row electrode pairs are formed and covered with a dielectric layer and the back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the intersections between row electrode pairs and column electrodes; a two-electrode AC PDP having discharge cells formed in the discharge space in positions corresponding to the intersections between row electrode pairs and column electrodes.

Further, the foregoing has described the example when the crystalline MgO layer 5 is formed through affixation by use of a spraying technique, an electrostatic coating technique or the like. However, the crystalline MgO layer 5 may be formed through application of a coating of a paste including vapor-phase MgO single crystals by use of a screen printing technique, an offset printing technique, a dispenser technique, an inkjet technique, a roll-coating technique or the like. Alternatively, for forming the crystalline MgO layer 5, a coating of a paste including MgO crystals may be applied onto a support film and then dried to a film, and then this film may be laminated on the thin-film MgO layer or the dielectric layer.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel, having a pair of substrates placed opposite each other on either side of a discharge space, discharge electrodes formed on one of the opposing substrates, and a dielectric layer covering the discharge electrodes, comprising:

a protective layer that covers the dielectric layer and has a magnesium oxide layer including magnesium oxide single crystals having a particle diameter of 2000 or more angstroms that have a crystalline structure causing a cathode-luminescence emission having a peak within a wavelength range of 200 nm to 300 nm upon excitation by an electron beam; and a ternary discharge gas including neon, xenon and helium and filling the discharge space;

wherein a concentration ratio of helium to neon in the ternary discharge gas ranges from 0.5 to 1.5, and wherein said magnesium oxide single crystals comprise randomly-oriented magnesium oxide single crystals.

2. A plasma display panel according to claim 1, wherein said concentration ratio of helium to neon in the ternary discharge gas ranges from 0.5 to 1.0.

3. plasma display panel according to claim 1 , wherein the magnesium oxide layer includes magnesium oxide single crystals obtained by performing vapor-phase oxidization on magnesium steam generated by heating magnesium.

4. plasma display panel according to claim 1, wherein the magnesium oxide single crystals cause the cathode-luminescence emission having a peak within a wavelength range from 230 nm to 250 nm.

5. A plasma display panel according to claim 1, wherein the protective layer has a laminated structure including the magnesium oxide layer that includes the magnesium oxide single crystals causing the cathode-luminescence emission and is formed on a thin-film magnesium oxide film formed by one of vapor deposition and sputtering.

6. A plasma display panel according to claim 1, wherein said protective layer further comprises a magnesium oxide thin film formed on said dielectric layer, said magnesium oxide layer including magnesium oxide single crystals being formed on said magnesium oxide thin film.

7. A plasma display panel according to claim 6, wherein said magnesium oxide layer including magnesium oxide single crystals is formed on one of a portion of said magnesium oxide thin film and an entire surface of said magnesium oxide thin film.

8. A plasma display panel according to claim 1, wherein for a concentration ratio a of Xe in said discharge gas, a concentration ratio of Ne in said discharge gas is in a range from $(1-\alpha)\times\frac{1}{2}$ to $(1-\alpha)\times\frac{2}{3}$, and a concentration ratio of he in said discharge gas is in a range from$(1-\alpha)\times\frac{1}{3}$ to$(1-\alpha)\times\frac{1}{2}$.

9. A plasma display panel according to claim 1, wherein said magnesium oxide single crystals comprise a cubic single crystal structure.

10. A plasma display panel according to claim 1, wherein said magnesium oxide single crystals comprise vapor-phase magnesium oxide single crystals.

11. A plasma display panel according to claim 1, wherein said magnesium oxide layer including magnesium oxide single crystals defines at least a portion of said discharge space.

12. A plasma display panel, having a pair of substrates placed opposite each other an either side of a discharge space, discharge electrodes formed on one of the opposing substrates, and a dielectric layer covering the discharge electrodes, comprising:

a protective layer that covers the dielectric layer and has a magnesium oxide layer including magnesium oxide single crystals having a particle diameter of 2000 or more angstroms that have a crystalline structure causing a cathode-luminescence emission having a peak within a wavelength range of 200 nm to 300 nm upon excitation by an electron beam; and a ternary discharge gas including neon, xenon and helium and filling the discharge space, wherein a concentration ratio of helium to neon in the ternary discharge gas ranges from 0.5 to 1.5, wherein said protective layer further comprises a magnesium oxide thin film formed on said dielectric layer, said magnesium oxide layer including magnesium oxide single crystals being fanned on said magnesium oxide thin film, and wherein said magnesium oxide layer including magnesium oxide single crystals is formed on a portion of said magnesium oxide thin film, an area ratio of said magnesium oxide layer including magnesium oxide single crystals to said magnesium oxide thin film being in a range from 1/1000 to 85/100.

* * * * *